US010718200B2

(12) United States Patent
Coste et al.

(10) Patent No.: US 10,718,200 B2
(45) Date of Patent: Jul. 21, 2020

(54) MONITORING AN ELECTRIC SUBMERSIBLE PUMP FOR FAILURES

(71) Applicant: Schlumberger Technology Corporation, Sugar Land, TX (US)

(72) Inventors: Emmanuel Coste, Houston, TX (US); Clare Schoene, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/173,640

(22) Filed: Oct. 29, 2018

(65) Prior Publication Data

US 2019/0063210 A1 Feb. 28, 2019

Related U.S. Application Data

(63) Continuation-in-part of application No. 15/314,890, filed as application No. PCT/US2015/033931 on Jun. 3, 2015, now Pat. No. 10,113,549.

(60) Provisional application No. 62/007,382, filed on Jun. 3, 2014.

(51) Int. Cl.

| | |
|---|---|
| ***E21B 47/00*** | (2012.01) |
| ***E21B 43/12*** | (2006.01) |
| ***F04D 15/00*** | (2006.01) |
| ***F04D 13/10*** | (2006.01) |

(Continued)

(52) U.S. Cl.

CPC ..... *E21B 47/008* (2020.05); *E21B 43/128* (2013.01); *F04D 13/10* (2013.01); *F04D 15/0077* (2013.01); *F04D 15/0088* (2013.01); *F04D 13/086* (2013.01); *F05D 2260/80* (2013.01)

(58) Field of Classification Search

CPC .... E21B 43/128; E21B 47/0007; F04D 13/10; F04D 15/0088

See application file for complete search history.

(56) References Cited

U.S. PATENT DOCUMENTS

| | | | |
|---|---|---|---|
| 4,509,901 | A | 4/1985 | McTamaney et al. |
| 5,284,422 | A | 2/1994 | Turner et al. |
| 5,362,206 | A | 11/1994 | Westerman et al. |

(Continued)

OTHER PUBLICATIONS

Search Report and Written Opinion of International Patent Application No. PCT/US2015/033931 dated Aug. 28, 2015, 14 pages.

(Continued)

*Primary Examiner* — David A. Rogers
(74) *Attorney, Agent, or Firm* — Trevor G. Grove

(57) ABSTRACT

A method for monitoring an electric submersible pump is provided. The method includes acquiring a baseline signature for the electric submersible pump in a first environment, acquiring a downhole signature for the electric submersible pump in a downhole environment while the electric submersible pump is confirmed to be healthy, applying an operator to the baseline signature and the downhole signature that results in a downhole noise component, acquiring a vibration signature for the electric submersible pump in the downhole environment while the electric submersible pump is in an operating mode, removing the downhole noise component from the vibration signature to produce an isolated electric submersible pump signature, and determining a health status of the electric submersible pump based on the isolated electric submersible pump signature.

18 Claims, 2 Drawing Sheets

(51) Int. Cl.
*F04D 13/08* (2006.01)
*E21B 47/008* (2012.01)

(56) References Cited

U.S. PATENT DOCUMENTS

| | | | |
|---|---|---|---|
| 6,590,362 | B2 | 7/2003 | Parlos et al. |
| 6,713,978 | B2 | 3/2004 | Parlos et al. |
| 6,763,312 | B1 | 7/2004 | Judd |
| 6,834,256 | B2 | 12/2004 | House et al. |
| 6,839,660 | B2 | 1/2005 | Eryurek et al. |
| 7,024,335 | B1 | 4/2006 | Parlos |
| 7,979,240 | B2 | 7/2011 | Fielder |
| 8,988,236 | B2 | 3/2015 | Liu et al. |
| 8,988,237 | B2 | 3/2015 | Liu et al. |
| 9,157,308 | B2 | 10/2015 | Balogun et al. |
| 9,280,517 | B2 | 3/2016 | Liu et al. |
| 9,394,899 | B2 | 7/2016 | Garvey et al. |
| 9,777,723 | B2 | 10/2017 | Wiegman et al. |
| 9,784,099 | B2 | 10/2017 | Kale et al. |
| 10,113,549 | B2 | 10/2018 | Coste |
| 2008/0262736 | A1 | 10/2008 | Thigpen et al. |
| 2010/0191484 | A1 | 7/2010 | Schoonover |
| 2011/0178737 | A1 | 7/2011 | Hudson et al. |
| 2013/0151156 | A1 | 6/2013 | Noui-Mehidi et al. |

OTHER PUBLICATIONS

International Preliminary Report on Patentability of International Patent Application No. PCT/US2015/033931 dated Dec. 15, 2016, 13 pages.

MONITORING AN ELECTRIC SUBMERSIBLE PUMP FOR FAILURES

CROSS-REFERENCE TO RELATED APPLICATIONS

The present application is a Continuation-in-Part application of U.S. patent application Ser. No. 15/314,890 filed Nov. 29, 2016, which was a 371 application of PCT/US2015/033931, filed Jun. 3, 2015, which claims priority to U.S. Provisional Application No. 62/007,382 filed Jun. 3, 2014, and entitled "Baseline Methodology for Improved ESP Failure Detection", each of which is incorporated herein in its entirety for all purposes.

STATEMENT REGARDING FEDERALLY SPONSORED RESEARCH OR DEVELOPMENT

Not applicable.

BACKGROUND

Electric submersible pumps (ESPs) may be deployed for any of a variety of pumping purposes. For example, where a substance (e.g., hydrocarbons in an earthen formation) does not readily flow responsive to existing natural forces, an ESP may be implemented to artificially lift the substance. If an ESP fails during operation, the ESP must be removed from the pumping environment and replaced or repaired, either of which results in a significant cost to an operator.

The ability to predict an ESP failure, for example by monitoring the operating conditions and parameters of the ESP, provides the operator with the ability to perform preventative maintenance on the ESP or replace the ESP in an efficient manner, reducing the cost to the operator. However, when the ESP is in a borehole environment, it is difficult to monitor the operating conditions and parameters with sufficient accuracy to accurately predict ESP failures.

SUMMARY

Embodiments of the present disclosure are directed to a method for monitoring an electric submersible pump. The method includes acquiring a baseline signature for the electric submersible pump in a first environment, acquiring a downhole signature for the electric submersible pump in a downhole environment while the electric submersible pump is confirmed to be healthy, applying an operator to the baseline signature and the downhole signature that results in a downhole noise component, acquiring a vibration signature for the electric submersible pump in the downhole environment while the electric submersible pump is in an operating mode, removing the downhole noise component from the vibration signature to produce an isolated electric submersible pump signature, and determining a health status of the electric submersible pump based on the isolated electric submersible pump signature.

Other embodiments of the present disclosure are directed to a system for monitoring an electric submersible pump. The system includes a vibration sensor coupled to the electric submersible pump to measure a vibration signature of the electric submersible pump and a processor. The processor receives the vibration signature for the electric submersible pump in a downhole environment from the vibration sensor and while the electric submersible pump is in an operating mode and removes a downhole noise component from the vibration signature to produce an isolated electric submersible pump signature. The downhole noise component is determined by applying an operator to a baseline signature for the electric submersible pump in a non-downhole environment and a downhole signature for the electric submersible pump in the downhole environment while the electric submersible pump is confirmed to be healthy. The processor further determines a health status of the electric submersible pump based on the isolated electric submersible pump signature.

Still other embodiments of the present disclosure are directed to a non-transitory computer-readable medium containing instructions that, when executed by a processor, cause the processor to receive a vibration signature for an electric submersible pump in a downhole environment from a vibration sensor and while the electric submersible pump is in an operating mode and remove a downhole noise component from the vibration signature to produce an isolated electric submersible pump signature. The downhole noise component is determined by applying an operator to a baseline signature for the electric submersible pump in a non-downhole environment and a downhole signature for the electric submersible pump in the downhole environment while the electric submersible pump is confirmed to be healthy. The instructions further cause the processor to determine a health status of the electric submersible pump based on the isolated electric submersible pump signature.

The foregoing has outlined rather broadly a selection of features of the disclosure such that the detailed description of the disclosure that follows may be better understood. This summary is not intended to identify key or essential features of the claimed subject matter, nor is it intended to be used as an aid in limiting the scope of the claimed subject matter.

BRIEF DESCRIPTION OF THE DRAWINGS

Embodiments of the disclosure are described with reference to the following figures.

DETAILED DESCRIPTION

Figure 1:
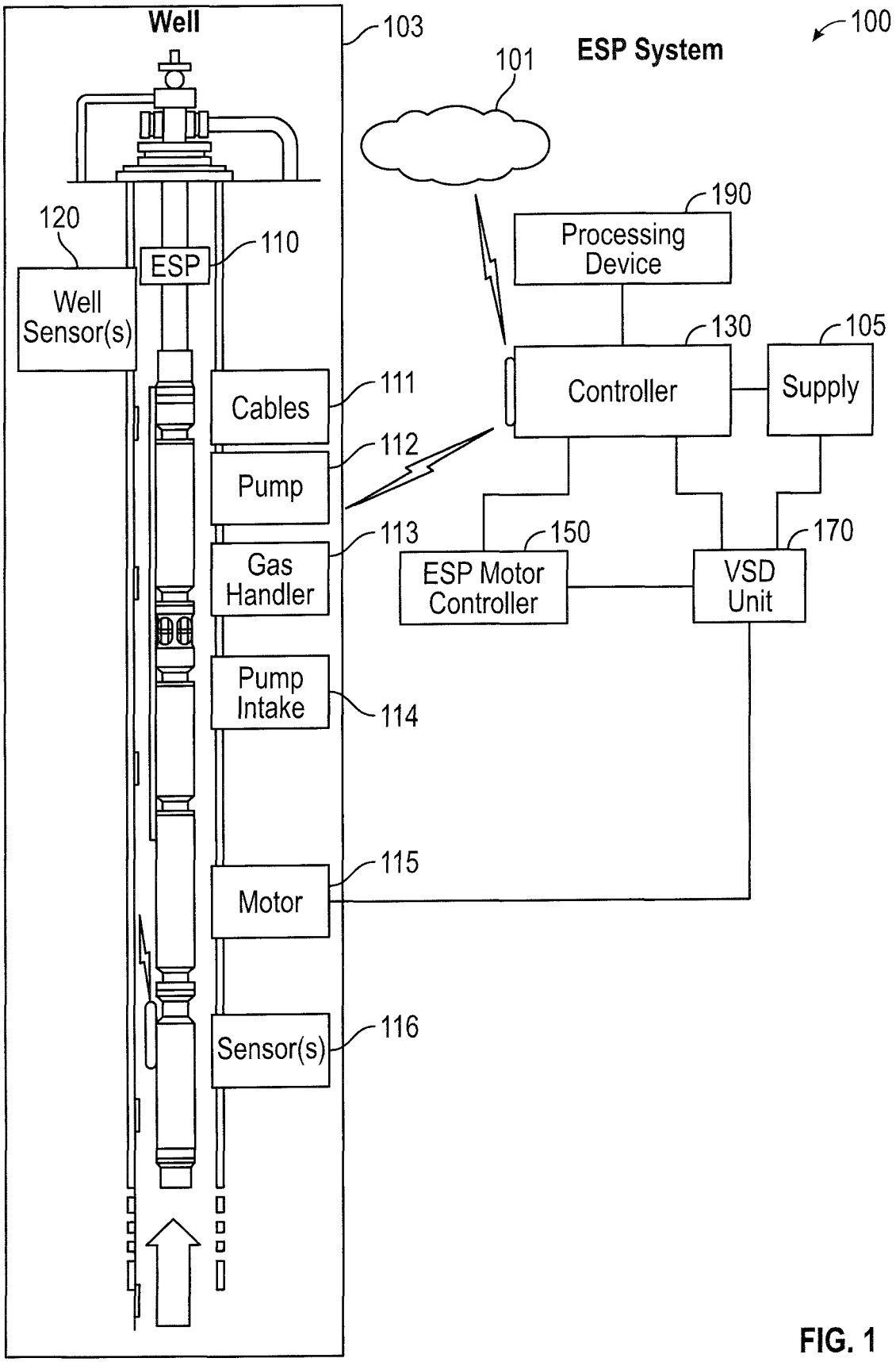
FIG. 1 illustrates an electric submersible pump and associated control and monitoring system deployed in a wellbore environment in accordance with various embodiments of the present disclosure.

One or more embodiments of the present disclosure are described below. These embodiments are merely examples of the presently disclosed techniques. Additionally, in an effort to provide a concise description of these embodiments, all features of an actual implementation may not be described in the specification. It should be appreciated that in the development of any such implementation, as in any engineering or design project, numerous implementation-specific decisions are made to achieve the developers' specific goals, such as compliance with system-related and business-related constraints, which may vary from one implementation to another. Moreover, it should be appreciated that such development efforts might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The embodiments discussed below are intended to be examples that are illustrative in nature and should not be construed to mean that the specific embodiments described herein are necessarily preferential in nature. Additionally, it should be understood that references to "one embodiment" or "an embodiment" within the present disclosure are not to be interpreted as excluding the existence of additional embodiments that also incorporate the recited features. The drawing figures are not necessarily to scale. Certain features and components disclosed herein may be shown exaggerated in scale or in somewhat schematic form, and some details of conventional elements may not be shown in the interest of clarity and conciseness.

The terms "including" and "comprising" are used herein, including in the claims, in an open-ended fashion, and thus should be interpreted to mean "including, but not limited to . . . ." Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections. If the connection transfers electrical power or signals, the coupling may be through wires or other modes of transmission. In some of the figures, one or more components or aspects of a component may be not displayed or may not have reference numerals identifying the features or components that are identified elsewhere in order to improve clarity and conciseness of the figure.

Electric submersible pumps (ESPs) may be deployed for any of a variety of pumping purposes. For example, where a substance does not readily flow responsive to existing natural forces, an ESP may be implemented to artificially lift the substance. Commercially available ESPs (such as the REDA™ ESPs marketed by Schlumberger Limited, Houston, Tex.) may find use in applications that require, for example, pump rates in excess of 4,000 barrels per day and lift of 12,000 feet or more.

To improve ESP operations, an ESP may include one or more sensors (e.g., gauges) that measure any of a variety of phenomena (e.g., temperature, pressure, vibration, etc.). A commercially available sensor is the Phoenix MultiSensor™ marketed by Schlumberger Limited (Houston, Tex.), which monitors intake and discharge pressures; intake, motor and discharge temperatures; and vibration and current leakage. An ESP monitoring system may include a supervisory control and data acquisition system (SCADA). Commercially available surveillance systems include the LiftWatcher™ and the LiftWatcher™ surveillance systems marketed by Schlumberger Limited (Houston, Tex.), which provides for communication of data, for example, between a production team and well/field data (e.g., with or without SCADA installations). Such a system may issue instructions to, for example, start, stop or control ESP speed via an ESP controller.

As explained above, it is difficult to monitor the operating conditions and parameters of an ESP while deployed in a borehole environment with sufficient accuracy to predict ESP failures. In the case of a surface mechanical rotating device such as a pump or motor, sensors (e.g., accelerometers, power meters, and vibration detectors) may be deployed to acquire data with a high sampling rate, for example up to several kHz, to detect early signs of failures on the rotating device. In some cases, a baseline is established during a first stage of rotating device life based on the sensor data, which defines a certain "signature" that corresponds to a healthy operating mode of the rotating device.

Subsequent acquisitions of sensor data indicative of operating conditions and/or parameters of the rotating device may be processed and compared to the established baseline signature. Various statistical and signal processing techniques, such as FFT, may be applied to monitor changes in the operating signature, which may refer to one or a combination of signatures derived from various sensor readings. Certain monitored changes may be known to correspond to a failure or a potential likelihood of failure of the rotating device. For devices on the surface where isolation from outside influence is simpler, this approach may provide suitable warning regarding potential failures of the rotating device.

However, when such a rotating device is deployed in a borehole environment for example, external sources of vibrations and other variables impact the failure detection algorithm described above. Such external influences may hide/obscure signals corresponding to a signature characteristic of failure by external variables or generate false alarm-type signatures where no failure is likely or actually occurring. In the particular case of an ESP, normal vibrational modes of the ESP may depend critically on its coupling to the wellbore environment.

Certain influences that introduce such external variables in the wellbore include changes in reservoir conditions, such as the presence of gas, sand, and the like. Further influences include changes in production flow rate, which can be caused by changes in the reservoir performance. Other noise that propagates through various tubing and completion hardware introduces further influence on the detected operating signature of the rotating device or ESP.

To overcome these external borehole influences, and in accordance with various embodiments of the present disclosure, a signature of an ESP or other rotating device known to be healthy is first acquired in a controlled environment, for example at the surface, to establish a known baseline signature. This signature may be established using one or a multiplicity of sensor types. The baseline signature thus establishes characteristic signal(s) of healthy ESP operation absent any external influence, such as that provided in a borehole environment. In certain embodiments, the baseline signature is established using a cable having a length approximately corresponding to the length to be used in downhole deployment. Further, the baseline signature may be established at a number of various flow rates. Thus, in some embodiments, the baseline signature may be observed ESP parameters at a certain flow rate; while in other embodiments, the baseline signature may be a matrix of ESP parameters observed at varying flow rates. In the case of multiple flow rates, the baseline signature may be considered as a function of flow rate Subsequently, the ESP or other rotating device is deployed downhole, although in a known, healthy state. At this point, a downhole signature may be acquired, which corresponds to a healthy state of the ESP, but also may indicate some influence of the borehole environment on the ESP signature. The downhole signature may be acquired either downhole or from surface electrical measurements. Similar to the baseline signature, the downhole signature may be acquired in varying operating conditions, such as varying the flow rate downhole (e.g., by changing the drive frequency at the surface). The flow rates used for acquiring the downhole signature may correspond to those used for acquiring the baseline signature, either being the same flow rates for each, or bearing some mathematical relationship to one another. As another example, during startup of the system, signatures may be acquired at different flow rates as the production tubing loads up and the annulus empties. Multiple motor speed signatures can be simultaneously acquired. Later, during production, the flowrate can be manipulated through adjustment of the motor speed or surface choke.

An operator may then be applied to the baseline signature and the downhole signature that results in a downhole noise component. The operator may take various forms, such as subtracting one of the baseline signature and the downhole signature from the other, or other known signal processing techniques to isolate a particular component contribution to an overall signature. As another example, using the baseline signature, a mathematical model may be created using common system identification methods including neural networks, state-space model estimation, and the like. The mathematical model may then be evaluated using the system inputs when the device, such as an ESP, is downhole. The residual between the difference in the model output and the measured system feedback can then be used to further create a downhole noise component or model for the downhole environment. By combining the outputs of the original model and the downhole noise model, the signature of a healthy device or ESP can be generated. As time progresses, system device or ESP health may deteriorate, and the residual from the healthy system model, composed of downhole noise and the surface model, and the system feedback defines the non-deterministic components of the system at that instant. The magnitude of these residuals (mean, RMS, peak-peak etc) can then be evaluated against thresholds to flag a fault. Further translation of the identified system model into a physics-based model enables a system state evaluation that can be used for fault diagnosis. Thus, the resulting downhole noise component corresponds to the noise, which may be a composite of various sensor readings or variables, induced by the borehole environment.

Normal operation of the ESP or rotating device downhole may subsequently commence, and ongoing sensor monitoring is performed. A vibration or other type of operating signature is thus acquired while the ESP is in an operating mode. The downhole noise component, explained above, is removed from the vibration signature in accordance with various embodiments. The resulting signature is then an isolated ESP signature, which can be processed using standard signal and frequency processing techniques to detect changes relative to the baseline signature to detect early signs of potential ESP failure. In certain embodiments, these early signs may be a deviation from the baseline signature in excess of a predetermined threshold. In other embodiments, these early signs may be a component of the isolated ESP signature absolutely exceeding a predetermined threshold. In still other embodiments, these early signs may be a combination of deviations from the baseline and absolutely exceeding various thresholds.

Whether early signs of a potential failure are detected may be referred to as a health status of the ESP, and an ESP that displays no signs of failure may be deemed healthy, while an ESP displaying signs of potential or outright failure may be deemed unhealthy. In other examples, health status may refer to a determination made as to whether ESP performance is degrading; that is, whether performance is changing in a potentially negative manner, rather than whether ESP performance meets some absolute performance benchmark to be deemed healthy or unhealthy. For example, in determining the health status, a frequency-based analysis such as FFT may be performed on the isolated ESP signature. In the event that an abnormal frequency component (e.g., a frequency component known to be likely indicative of impending failure) is identified, a failing indication may be generated. Similarly, in the absence of such abnormal frequency components, a passing indication may be generated. In the example where the determination is change-based, in the event the frequency-based analysis demonstrates a shift in the isolated ESP signature in a way that is known or suspected to be negative, a warning or failing indication may be generated. In the absence of such a shift in the isolated ESP signature, no warning or a passing indication may be generated.

Referring now to FIG. 1, an example of an ESP system 100 is shown. The ESP system 100 includes a network 101, a well 103 disposed in a geologic environment, a power supply 105, an ESP 110, a controller 130, a motor controller 150, and a VSD unit 170. The power supply 105 may receive power from a power grid, an onsite generator (e.g., a natural gas driven turbine), or other source. The power supply 105 may supply a voltage, for example, of about 4.16 kV.

The well 103 includes a wellhead that can include a choke (e.g., a choke valve). For example, the well 103 can include a choke valve to control various operations such as to reduce pressure of a fluid from high pressure in a closed wellbore to atmospheric pressure. Adjustable choke valves can include valves constructed to resist wear due to high velocity, solids-laden fluid flowing by restricting or sealing elements. A wellhead may include one or more sensors such as a temperature sensor, a pressure sensor, a solids sensor, and the like.

The ESP 110 includes cables 111, a pump 112, gas handling features 113, a pump intake 114, a motor 115 and one or more sensors 116 (e.g., temperature, pressure, current leakage, vibration, etc.). The well 103 may include one or more well sensors 120, for example, such as the commercially available OpticLine™ sensors or WellWatcher Brite-Blue™ sensors marketed by Schlumberger Limited (Houston, Tex.). Such sensors are fiber-optic based and can provide for real time sensing of downhole conditions. Measurements of downhole conditions along the length of the well can provide for feedback, for example, to understand the operating mode or health of an ESP. Well sensors may extend thousands of feet into a well (e.g., 4,000 feet or more) and beyond a position of an ESP.

The controller 130 can include one or more interfaces, for example, for receipt, transmission or receipt and transmission of information with the motor controller 150, a VSD unit 170, the power supply 105 (e.g., a gas fueled turbine generator or a power company), the network 101, equipment in the well 103, equipment in another well, and the like. The controller 130 may also include features of an ESP motor controller and optionally supplant the ESP motor controller 150.

The motor controller 150 may be a commercially available motor controller such as the UniConn™ motor controller marketed by Schlumberger Limited (Houston, Tex.). The UniConn™ motor controller can connect to a SCADA system, the LiftWatcher™ surveillance system, etc. The UniConn™ motor controller can perform some control and data acquisition tasks for ESPs, surface pumps, or other monitored wells. The UniConn™ motor controller can interface with the Phoenix™ monitoring system, for example, to access pressure, temperature, and vibration data and various protection parameters as well as to provide direct current power to downhole sensors. The UniConn™ motor controller can interface with fixed speed drive (FSD) controllers or a VSD unit, for example, such as the VSD unit 170.

In accordance with various examples of the present disclosure, the controller 130 may include or be coupled to a processing device 190. Thus, the processing device 190 is able to receive data from ESP sensors 116 and/or well sensors 120. As will be explained in further detail below, the processing device 190 analyzes the data received from the sensors 116 and/or 120 to generate a health status of the ESP 110. The controller 130 and/or the processing device 190 may also monitor surface electrical conditions (e.g., at the output of the drive) to gain knowledge of certain downhole parameters, such as downhole vibrations, which may propagate through changes in induced currents. Thus, a vibration sensor may refer to a downhole gauge or sensor, or surface electronics such as the controller 130 and/or processor 190 that measure downhole conditions through other means, such as change in various monitored electrical parameters. The health status of the ESP 110 may be presented to a user through a display device (not shown) coupled to the processing device 190, through a user device (not shown) coupled to the network 101, or other similar manners.

Figure 2:
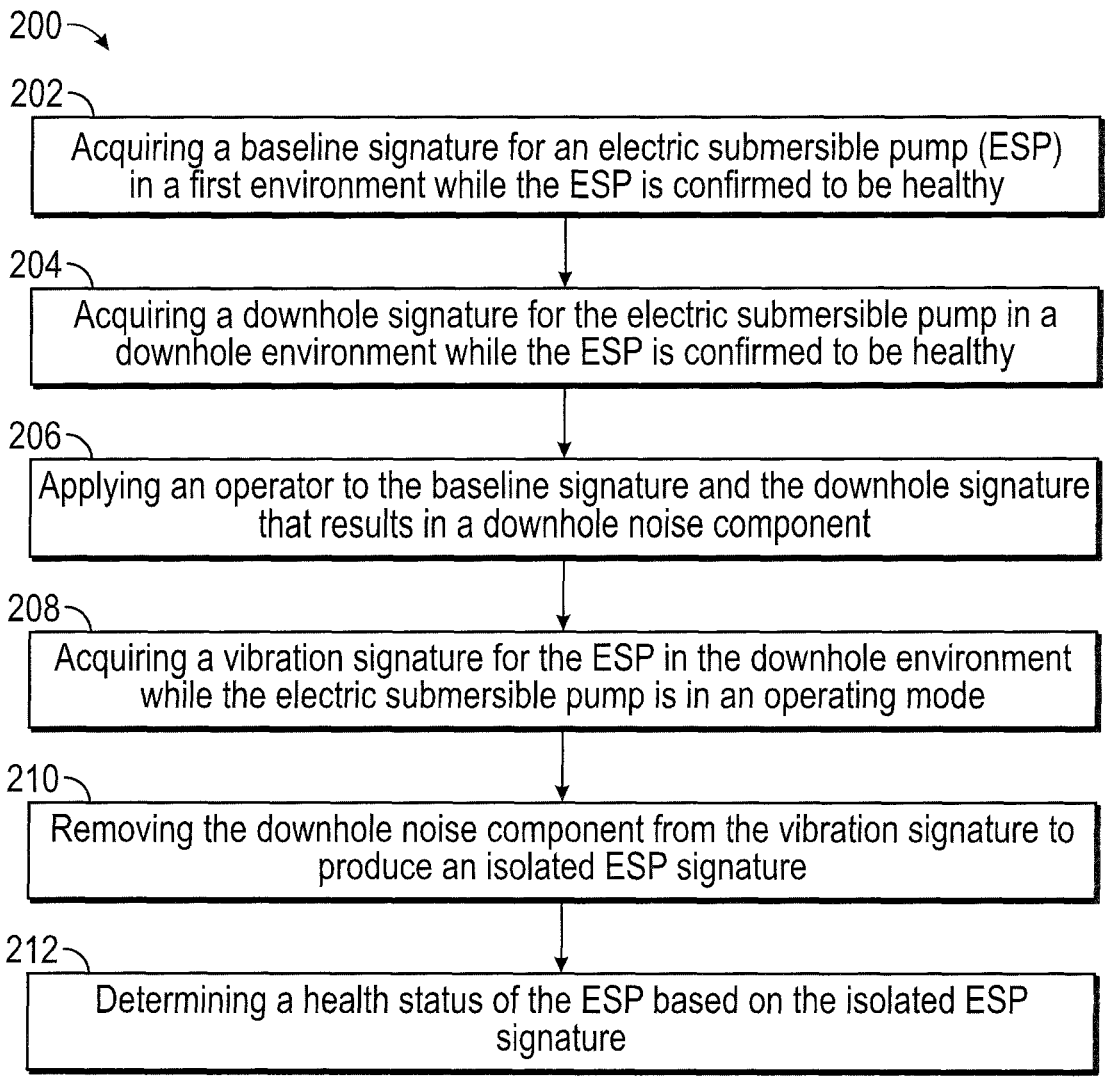
FIG. 2 illustrates a flow chart of a method for monitoring an electric submersible pump in accordance with various embodiments of the present disclosure.

FIG. 2 shows a flow chart of a method 200 in accordance with various embodiments of the present disclosure. The method 200 may be performed at least in part by the processing device 190 described above in response to receiving data from ESP sensors 116 and/or well sensors 120. The method 200 begins in block 202 with acquiring a baseline signature for the ESP 110 that is confirmed to be healthy. The baseline signature is acquired with the ESP 110 in a controlled environment, for example at the surface. This signature may be established using one or a multiplicity of sensor types. The baseline signature thus establishes characteristic signal(s) of healthy ESP 110 operation absent any external influence, such as that provided in a borehole environment. Although not shown explicitly in block 202, the baseline signature may further be established at a number of various flow rates or pump operating frequencies. Thus, in some embodiments, the baseline signature may be observed ESP 110 parameters at a certain flow rate or pump frequency; while in other embodiments, the baseline signature may be a matrix of ESP 110 parameters observed at varying flow rates or pump operating frequencies. In the case of multiple flow rates or operating frequencies, the baseline signature may be considered as a function of flow rate or operating frequency. In other examples, the baseline signature may be established as a function of other parameters as variables, such as fluid density and the like.

Subsequently, the ESP 110 is deployed downhole, although in a known, healthy state and the method 200 continues in block 204 with acquiring a downhole signature for the ESP 110 in a downhole environment while the ESP 110 is confirmed to be healthy. The downhole signature may indicate some influence of the borehole environment on the ESP 110 signature. Although the downhole signature may be acquired from downhole sensors, the downhole signature may also be acquired, for example, through surface electrical measurements. Similar to the baseline signature determined in block 202, the downhole signature may be acquired in varying operating conditions, such as varying the flow rate downhole (e.g., by changing the drive frequency at the surface), varying pump frequencies, varying fluid densities, and other parameters that may influence the ESP 110 signature.

The method 200 continues in block 206 with applying an operator to the baseline signature and the downhole signature that results in a downhole noise component. The operator may take various forms, such as subtracting one of the baseline signature and the downhole signature from the other, or other known signal processing techniques to isolate a particular component contribution to an overall signature. The resulting downhole noise component thus corresponds to the noise, which may be a composite of various sensor readings or variables, induced by the borehole environment.

The ESP 110 is then used in a normal operating manner downhole, and the method 200 continues in block 208 with acquiring a vibration or operating (i.e., based on other parameters in addition to or including vibrations) signature for the ESP 110 in the downhole environment. The method 200 also includes removing the downhole noise component from the vibration signature to produce an isolated ESP 110 signature in block 210. The isolated ESP 110 signature can be processed using standard signal and frequency processing techniques to detect changes relative to the baseline signature to detect early signs of potential ESP 110 failure. In certain embodiments, these early signs may be a deviation from the baseline signature in excess of a predetermined threshold. In other embodiments, these early signs may be a component of the isolated ESP signature absolutely exceeding a predetermined threshold. In still other embodiments, these early signs may be a combination of deviations from the baseline and absolutely exceeding various thresholds.

Whether early signs of a potential failure are detected may be referred to as a health status of the ESP 110, and an ESP 110 that displays no signs of failure may be deemed healthy, while an ESP 110 displaying signs of potential or outright failure may be deemed unhealthy. In view of this, the method 200 also includes determining a health status of the electric submersible pump based on the isolated ESP 110 signature in block 212. For example, in determining the health status, a frequency-based analysis such as FFT may be performed on the isolated ESP 110 signature. In the event that an abnormal frequency component (e.g., a frequency component known to be likely indicative of impending failure) is identified, a failing indication may be generated. Similarly, in the absence of such abnormal frequency components, a passing indication may be generated.

Referring briefly back to FIG. 1, the processing device 190 is to execute instructions read from a computer-readable medium, and may be a general-purpose processor, digital signal processor, microcontroller, and the like. Processor architectures generally include execution units (e.g., fixed point, floating point, and integer), storage (e.g., registers and memory), instruction decoding, peripherals (e.g., interrupt controllers, timers, and direct memory access controllers), input/output systems (e.g., serial ports and parallel ports), and various other components and sub-systems.

Figure 3:
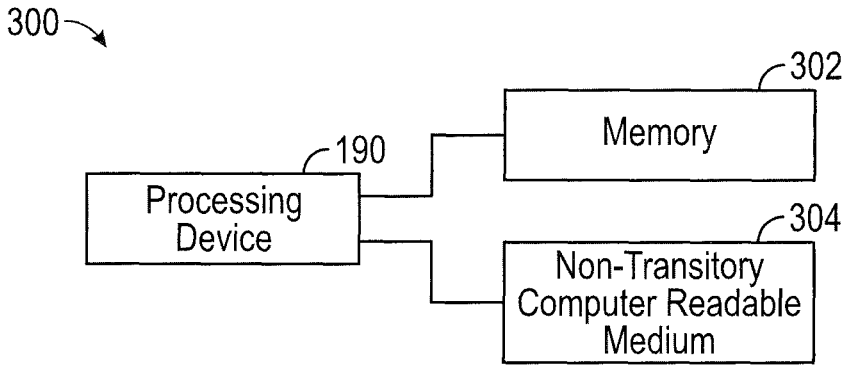
FIG. 3 illustrates a block diagram illustrating another system for monitoring an electric submersible pump in accordance with various embodiments of the present disclosure.

Turning to FIG. 3, a system 300 is shown in accordance with various embodiments of the present disclosure. The system 300 includes the processing device 190 shown in FIG. 1, which is coupled to a memory 302 and a non-transitory computer-readable medium 304. In this way, instructions contained on the non-transitory computer-readable medium 304 are accessible to the processing device 190. For example, the processing unit 190 may directly access the instructions, or the instructions may be loaded into the memory 302 from the non-transitory computer-readable medium 304. The non-transitory computer-readable medium 304 itself may include volatile and/or non-volatile semiconductor memory (e.g., flash memory or static or dynamic random access memory), or other appropriate storage media now known or later developed. Various program instructions executable by the processing device 190, and data structures manipulatable by the processing device 190, may be stored in the non-transitory computer-readable medium 304. In accordance with various embodiments, the program(s) stored in the non-transitory computer-readable medium 304, when executed by the processing unit 190, may cause the processing unit 190 to carry out any of the methods or portions of the methods described herein.

Using the various embodiments of monitoring an ESP 110 described herein, a downhole noise component, explained above, may be removed from the vibration or operating signature of the ESP 110. Thus, the resulting signature is then an isolated ESP 110 signature, which can be processed using standard signal and frequency processing techniques to detect changes relative to the baseline signature to detect early signs of potential ESP failure. These early signs may be a deviation from the baseline signature in excess of a predetermined threshold. These early signs may alternately be a component of the isolated ESP signature absolutely exceeding a predetermined threshold. Further, these early signs may be a combination of deviations from the baseline and absolutely exceeding various thresholds. As a result, it may be possible to monitor the operating conditions and parameters of an ESP 110 while deployed in a borehole environment with sufficient accuracy to predict ESP 110 failures.

In one or more embodiments, the method can be implemented using a digital twin. The digital twin can be customized for an associated ESP. The digital twin can include manufacturing data, performance data, and other specific data for the ESP. The digital twin can also have one or more dynamic models. For example, one of the models can be constructed as described above.

In addition, other models that can be loaded into the twin can be stored in the cloud. The other models can include production fluid performance models. The production fluid performance models can be a data driven model, that uses measured data for several ESP pumps when different fluids are produced. The production fluids can be correlated to downhole signatures of several ESP pumps operating in the oil field. The production fluid performance model can then be loaded into the digital twin and updated from the cloud. As the ESP associated with the digital twin operates, the digital twin can alert when a change in the baseline signature is measured, and can switch to the production fluid performance model to determine if the change in baseline signature is due to a fault with the ESP or due to a change in production fluid. If it is determined that the production fluid has changed the digital twin can indicate a change in production fluid and request an update performance model from the cloud for the specific production fluid. The performance model can be a data driven model that is built using test data from the associated ESP and aggregated data from other ESPs. This model can have a new baseline signature and can use the signature from the associated ESP to determine the health of the ESP from the signatures of the baseline as described above and then perform one or more methods as described herein.

In one or more embodiments, the data from the digital twin can be aggregated on the cloud with data from other ESPs to dynamically calibrate the models in the cloud.

In one or more embodiments, if a change in production fluid is determined the digital twin (also referred to as the digital avatar) can be used to control or adjust the operation of the ESP using optimization models for the associated ESP and the identified production fluid.

One embodiment of the method can include the following processes. The method can include providing a digital twin that is configured to perform the method 200 disclosed above and which is unique and associated with an ESP that is being monitored. The method can include communicating the digital twin with the ESP to acquire the necessary data, as disclosed in method 200. The method can also include comparing a deviation in the signature to a production fluid model to determine if production fluid has changed. The method also includes using an original health model if there is no correlation to a change in production fluid, or switching to a performance model if a change in production fluid is determined. The performance model is selected to match the new production fluid.

Although only a few example embodiments have been described in detail above, those skilled in the art will readily appreciate that many modifications are possible in the example embodiments without materially departing from the systems and methods disclosed herein. Features shown in individual embodiments referred to above may be used together in combinations other than those which have been shown and described specifically. Accordingly, all such modifications are intended to be included within the scope of this disclosure as defined in the following claims.

The embodiments described herein are examples only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims.

What is claimed is:

1. A method for monitoring an electric submersible pump, comprising:

acquiring a baseline signature for the electric submersible pump in a first environment while the electric submersible pump is confirmed to be healthy;

acquiring a downhole signature for the electric submersible pump in a downhole environment while the electric submersible pump is confirmed to be healthy;

applying an operator to the baseline signature and the downhole signature that results in a downhole noise component;

acquiring a vibration signature for the electric submersible pump in the downhole environment while the electric submersible pump is in an operating mode;

removing the downhole noise component from the vibration signature to produce an isolated electric submersible pump signature; and determining, using a processor in communication with a digital twin associated with the electric submersible pump, at least one of a health status of the electric submersible pump based on the isolated electric submersible pump signature and a change in production fluid based on a deviation of the isolated electric submersible pump signature from the baseline signature and the output of a production fluid model.

2. The method of claim 1 wherein determining a health status further comprises performing a frequency-based analysis on the isolated electric submersible pump signature.

3. The method of claim 2 further comprising identifying a frequency component indicative of electric submersible pump failure and, based on the identification of the frequency component, generating a failing indication.

4. The method of claim 1 wherein the baseline signature is determined for multiple pump flow rates.

5. The method of claim 4 wherein the downhole signature is determined for multiple pump flow rates.

6. The method of claim 5 wherein the flow rates used to determine the baseline signature correspond to the flow rates used to determine the downhole signature.

7. The method of claim 1 wherein the first environment is a controlled surface environment.

8. A system for monitoring an electric submersible pump, the system comprising:

a vibration sensor coupled to the electric submersible pump to measure a vibration signature of the electric submersible pump; and a processor having a digital twin associated with the electric submersible pump and coupled to the vibration sensor to:

receive the vibration signature for the electric submersible pump in a downhole environment from the vibration sensor and while the electric submersible pump is in an operating mode;

remove a downhole noise component from the vibration signature to produce an isolated electric submersible pump signature, wherein the downhole noise component is determined by applying an operator to a baseline signature for the electric submersible pump in a non-downhole environment and a downhole signature for the electric submersible pump in the downhole environment while the electric submersible pump is confirmed to be healthy; and determine a health status of the electric submersible pump based on the isolated electric submersible pump signature.

9. The system of claim 8 wherein when the processor determines the health status, the processor performs a frequency-based analysis on the isolated electric submersible pump signature.

10. The system of claim 9 wherein the processor further identifies a frequency component indicative of electric submersible pump failure and, based on the identification of the frequency component, generates a failing indication.

11. The system of claim 8 wherein the baseline signature is determined for multiple flow rates.

12. The system of claim 11 wherein the downhole signature is determined for multiple flow rates.

13. The system of claim 12 wherein the flow rates used to determine the baseline signature correspond to the flow rates used to determine the downhole signature.

14. The system of claim 8 wherein the non-downhole environment is a controlled surface environment.

15. The system of claim 8, wherein the digital twin comprises a production fluid model.

16. The system of claim 15, wherein the production fluid model is one of a data driven model.

17. The system of claim 15, wherein the digital twin alerts when there is a change in a baseline signature of the electrical submersible pump, and wherein the digital twin switches to the production fluid model to determine if the change in baseline signature is due to a fault with the electrical submersible pump or a change in production fluid.

18. The system of claim 17, the digital twin uses a optimization model for the electrical submersible pump, and wherein the digital twin is configured to control or adjust the operation of the electrical submersible pump when a change in production fluid is determined.

* * * * *